US006598246B1

(12) United States Patent
Shou

(10) Patent No.: US 6,598,246 B1
(45) Date of Patent: Jul. 29, 2003

(54) TOILET SEAT LIFTING MECHANISM

(75) Inventor: Eric Shou, Hsin Tien (TW)

(73) Assignee: Dynamic Healthtech Inc., Taipei (TW)

( * ) Notice: Subject to any disclaimer, the term of this patent is extended or adjusted under 35 U.S.C. 154(b) by 0 days.

(21) Appl. No.: 10/151,604

(22) Filed: May 18, 2002

(51) Int. Cl.[7] ..... A47K 13/10
(52) U.S. Cl. ..... 4/667; 4/254; 297/DIG. 10
(58) Field of Search ..... 4/254, 667, 420, 4/560; 297/DIG. 10; 5/81.1, 83.1

(56) References Cited

U.S. PATENT DOCUMENTS 3,473,174 A * 10/1969 Cool ..... 4/667
5,661,858 A * 9/1997 House et al. ..... 4/667
6,189,164 B1 * 2/2001 Krapu ..... 4/667
6,213,554 B1 * 4/2001 Marcoux et al. ..... 297/330
6,360,382 B1 * 3/2002 Karash ..... 4/667
6,385,797 B1 * 5/2002 Phillips ..... 4/667
6,470,513 B1 * 10/2002 Cook ..... 4/667
6,507,961 B1 * 1/2003 Ming-Hwa ..... 4/667

* cited by examiner

*Primary Examiner*—Gregory Huson
*Assistant Examiner*—Amanda R. Flynn
(74) *Attorney, Agent, or Firm*—W. Wayne Liauh

(57) ABSTRACT

A toilet seat lifting mechanism includes an upstanding base frame, a movable frame pivotally connected at a front end to a top front of the base frame, a toilet seat support pivotally connected at a rear edge to a rear end of the movable frame, and a toilet seat pivotally connected at a rear end to the rear edge of the toilet seat support to flatly position on a top of the toilet seat support. A lifter is mounted to one side of the base frame to gradually lift the rear end of the movable frame, so that the toilet seat support and the toilet seat are forward inclined to gradually move a user sitting on the toilet seat into an upstanding position.

3 Claims, 5 Drawing Sheets

TOILET SEAT LIFTING MECHANISM

BACKGROUND OF THE INVENTION

The present invention relates to a toilet seat lifting mechanism, and more particularly to a structurally simplified toilet seat lifting mechanism for assisting a patient or an aged person having weak leg supporting force in safely and conveniently sitting on and standing up from a toilet seat.

When a person becomes older, his or her physiological functions would degrade gradually. The aged bones and muscles would result in spongy bones and reduced bone and muscle supportability. That is why old people move slower than the youth and it is laborious to sit down and stand up.

Sitting down and standing up are two movements that necessarily occur when people go to the toilet. For old people who move slowly and patients who have injured legs, it is necessary to have an attendant to help them sit down and stand up in the course of using the toilet. However, this is a private behavior and involves dirty excretions. Most people would prefer to use the toilet alone without someone else standing beside him or her. The old men and/or the patients failing to do so would feel depressed, useless, or even lose the courage to live.

SUMMARY OF THE INVENTION

A primary object of the present invention is to provide a structurally simplified toilet seat lifting mechanism that can be conveniently operated through power to gradually lift a toilet seat, so that a patient or an aged person sitting thereon could be moved into an upstanding position without the need of exerting too much strength at their legs. The toilet seat lifting mechanism of the present invention may also be driven to gradually lower the toilet seat from a forward inclined position to a horizontal position to assist the patient and the aged person in sitting onto the toilet seat in an effortless manner.

To achieve the above and other objects, the toilet seat lifting mechanism of the present invention mainly includes an upstanding base frame, a movable frame pivotally connected at a front end to a top front of the base frame, a toilet seat support pivotally connected at a rear edge to a rear end of the movable frame, and a toilet seat pivotally connected at a rear end to the rear edge of the toilet seat support to, horizontally position on a top of the toilet seat support. A lifter is mounted to one side of the base frame to gradually lift the rear end of the movable frame, so that the toilet seat support and the toilet seat are forward inclined to gradually move a user sitting on the toilet seat into an upstanding position.

The toilet seat lifting mechanism of the present invention also includes two sets of linkage symmetrically mounted to two inner sides of the base frame, such that when the lifter lifts the rear end of the movable frame, the two sets of linkage also slightly lift the front ends of the toilet seat support and the toilet seat supported thereon. This arrangement protects the patient or the aged person sitting on the toilet seat against sudden sliding downward when the toilet seat is moved from the horizontal position into the forward inclined position.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
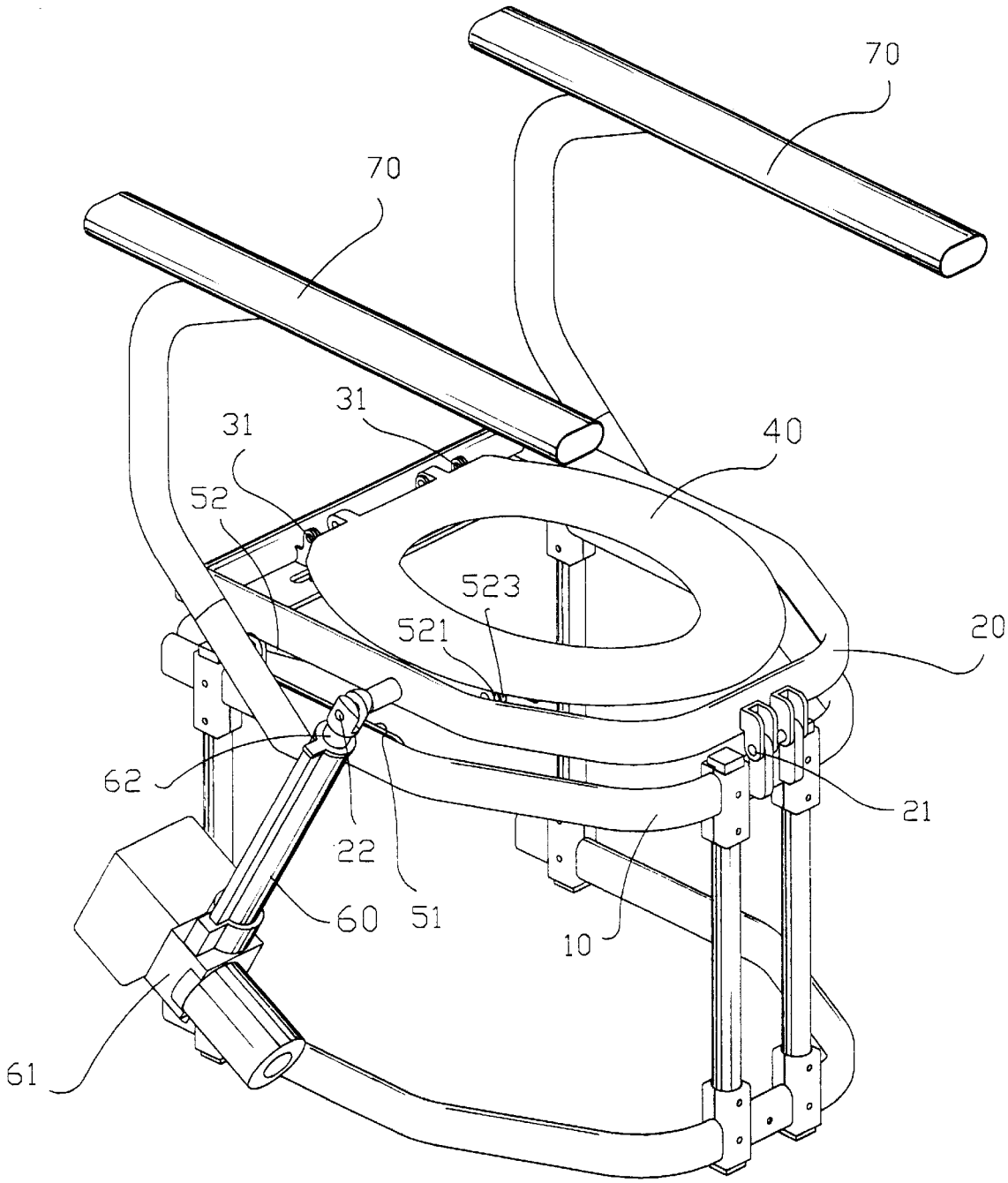
FIG. 1 is a perspective view of a toilet seat lifting mechanism according to the present invention with the toilet seat in a horizontal position.
Figure 2:
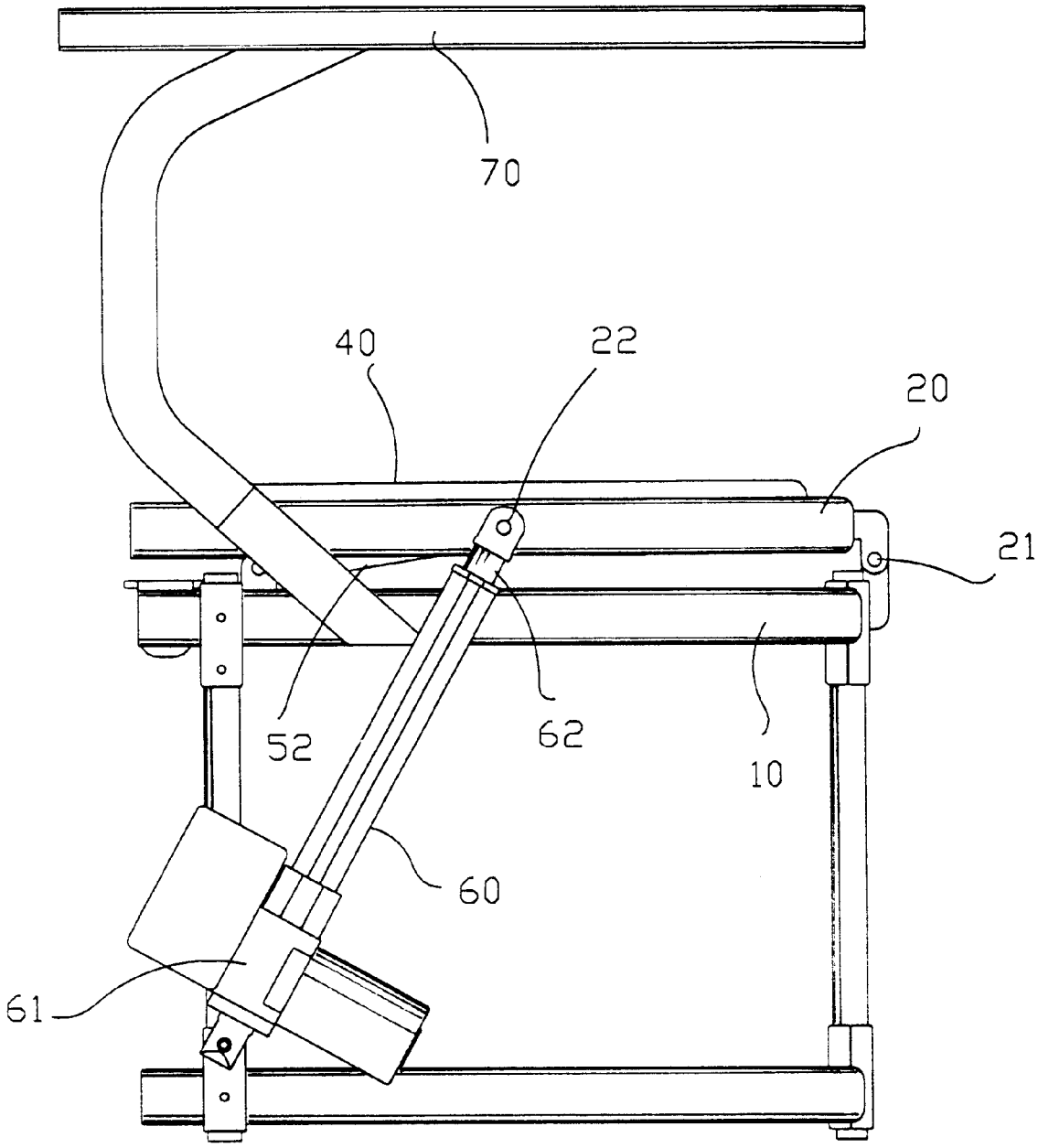
FIG. 2 is a side view of FIG. 1.
Figure 3:
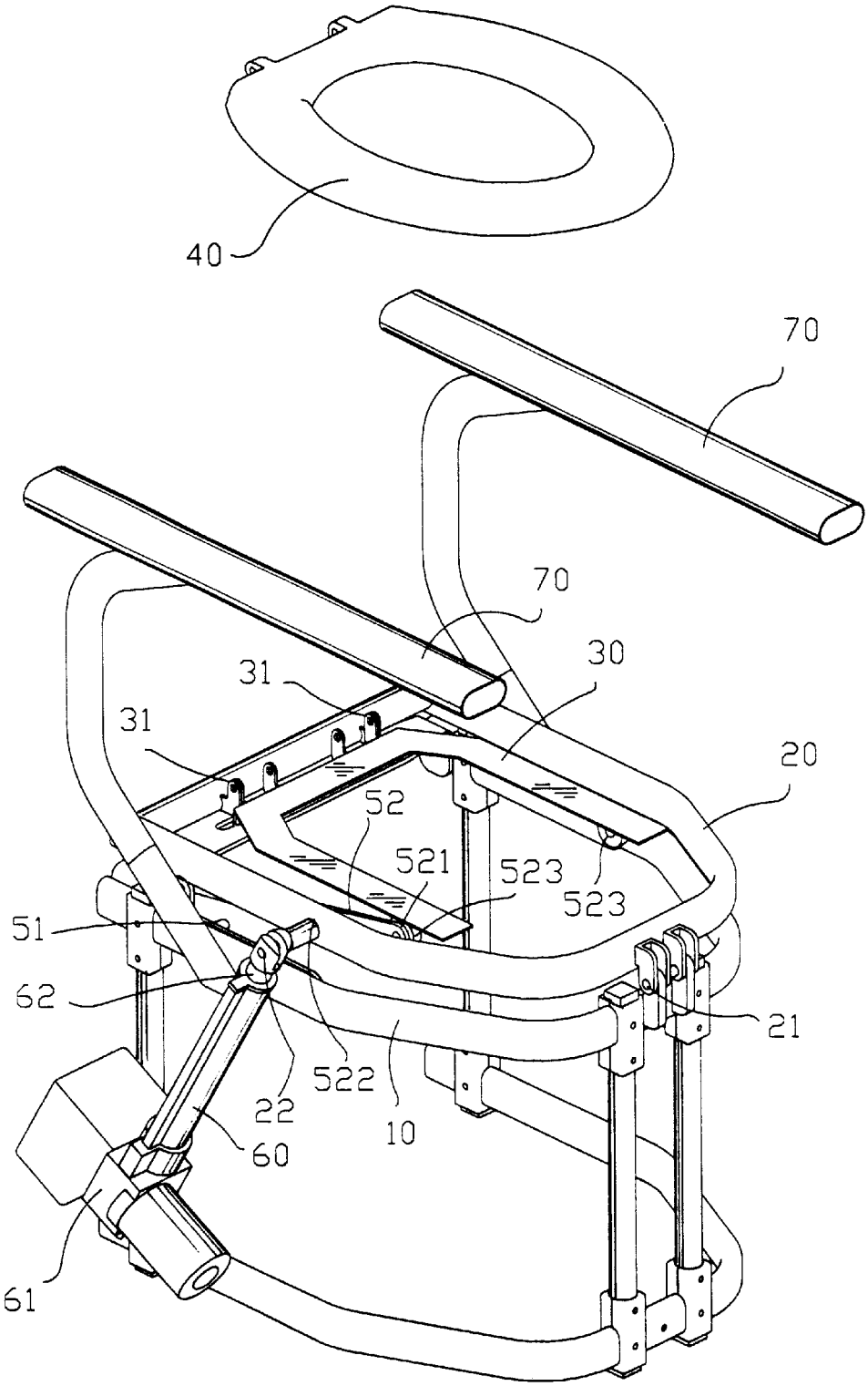
FIG. 3 is similar to FIG. 1 with the toilet seat separated from the toilet seat lifting mechanism.

Please refer to FIGS. 1 and 2 that are perspective and side views, respectively, of a toilet seat lifting mechanism according to the present invention. As shown, the toilet seat lifting mechanism mainly includes a base frame 10, a movable frame 20, a toilet seat support 30 (see FIG. 3), a toilet seat 40, two sets of linkage 50 (see FIG. 4), and a lifter 60.

The base frame 10 is an upstanding framework defining a rearward opening and a horizontal top plane. The pivoting point 21 to a top front of the base frame 10. Please also refer to FIG. 3. The toilet seat support 30 is a U-shaped member defining a forward opening, and is pivotally connected at pivoting points 31 on a rear edge thereof to a top rear end of the movable frame 20. The toilet seat 40 is pivotally connected at a rear end to the rear edge of the toilet seat support 30 to normally flatly position on a top of the toilet seat support 30. Please also refer to FIG. 4. The two sets of linkage 50 are laterally symmetrically mounted in the toilet seat lifting mechanism. Each set of the linkage 50 includes two links, namely, a lower link 51 and an upper link 52. The lower link 51 is pivotally connected at a front end to an upper frame of the base frame 10 and at a rear end to a rear end of the upper link 52. The upper link 52 is pivotally connected at a near-middle point to the movable frame 20, and in movable contact at a front end 521 with an underside of the toilet seat 30. The lifter 60 includes a base 61 pivotally connected to a lower frame of the base frame 10, and an extension shaft 62 having an outer end pivotally connected to a predetermined pivoting point 22 on the movable frame 20.

Figure 4:
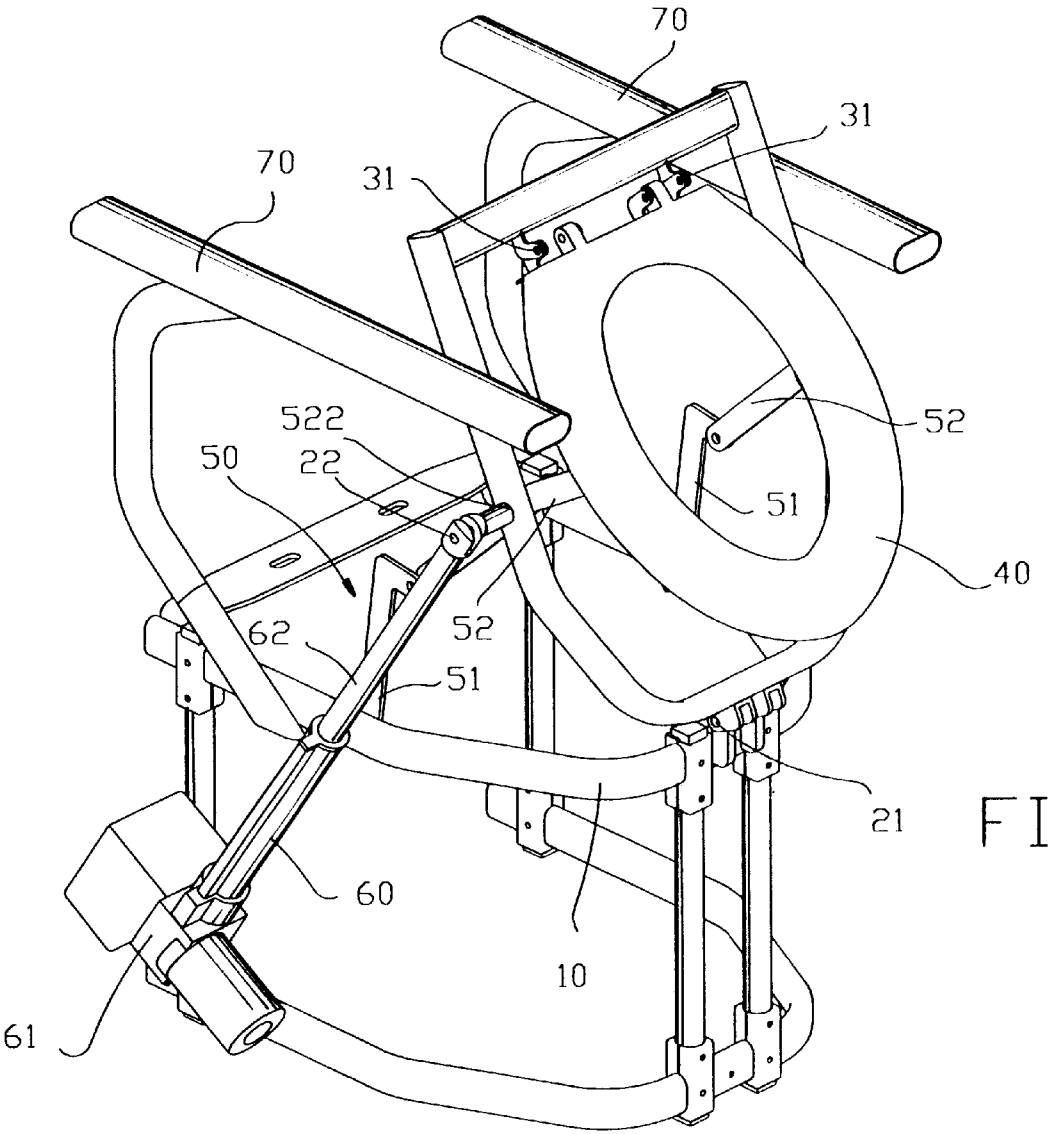
FIG. 4 is perspective view of the toilet lifting mechanism of FIG. 1 with the toilet seat in a forward inclined position.
Figure 5:
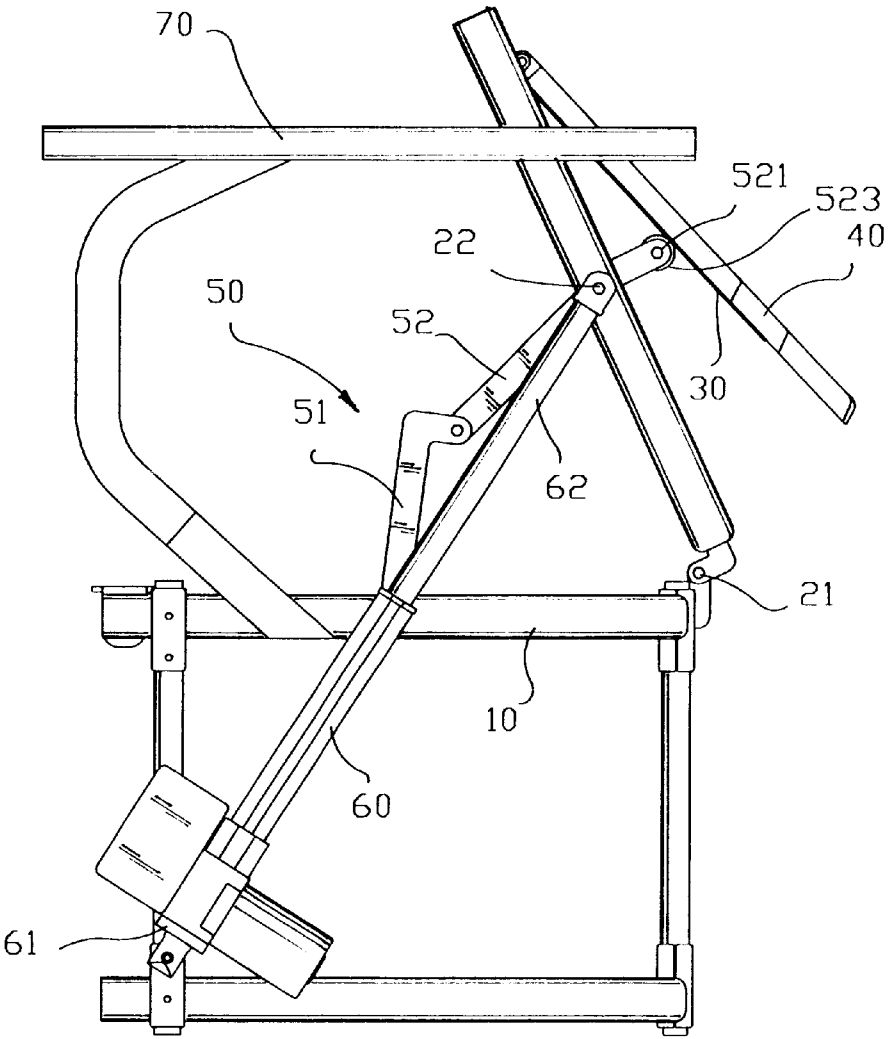
FIG. 5 is a side view of FIG. 4.

Please refer to FIGS. 4 and 5. When the lifter 60 is actuated to outward extend the extension shaft 62, the movable frame 20 is caused to turn upward about the front pivoting point 21 into a forward inclined position with a rear end thereof being lifted. While the movable frame 20 is lifted into the forward inclined position, the front end 521 of the upper link 52 gradually moves into a position higher than a pivoting point 522 at where the near-middle point of the upper link 52 are pivotally connected to the movable frame 20. This brings the toilet seat support 30 to pivotally turn about the pivoting points 31 on its rear edge into a forward inclined position with a front end thereof being slightly lifted from the movable frame 20. That is, the toilet seat 40 supported on the toilet seat support 30 in the forward inclined and slightly lifted position has a gradient smaller than that of the movable frame 20. With this design, a user sit on the toilet seat 40 is protected against sudden sliding downward while the movable frame 20 and, accordingly, the toilet seat 40, are being turned to lift their rear edges. The toilet seat lifting mechanism of the present invention is therefore safe for use.

The upper links 52 of the two sets of linkage 50 are provided at their front ends with two rollers 523 that rotatably contact with the underside of the toilet seat support 30 to enable a reduced frictional coefficient between them and the toilet seat support 30.

The pivoting points 522 connecting the upper links 52 and the movable frame 30 and the pivoting point 22 connecting the extension shaft 62 and the movable frame 30 maybe located at the same one pivot shaft to simplify the toilet seat lifting mechanism.

In another embodiment of the present invention, two lifters 60 may be separately provided at two lateral sides of the base frame 10 to provide enhanced supporting force.

Two armrests 70 are separately provided at two sides of the base frame 10 for a user to safely rest on. Since the armrests 70 could be provided to the toilet seat lifting mechanism through known skill, the provision thereof is not a key point of the present invention. A push button (not shown) for controlling the lifter 60 may be provided on one of the two armrests 70 for conveniently operating by the user.

The rearward opening of the base frame 10 allows the base frame 10 to conveniently enclose around a lower portion of a general toilet (not shown). The whole base frame 10 has a configuration corresponding to that of a bowl of the general toilet, particularly has a gradually narrowed front portion, so that a user may naturally separate two legs to stand at two sides of the narrowed front portion before and after using the toilet. As in a general toilet, the toilet seat 40 is pivotally connected at the rear end to the toilet seat support 30 and can be easily turned rearward about the pivoting points and lifted.

With the above arrangements, the toilet seat lifting mechanism of the present invention has simple structure that can be manufactured at largely reduced cost to meet the need of general consumers.

What is claimed is:

1. A toilet seat lifting mechanism, comprising a base frame, a movable frame, a toilet seat support, a toilet seat, two sets of linkage, and at least one lifter;

said base frame being an upstanding framework defining a rearward opening and a horizontal top plane;

said movable frame being pivotally connected at a front pivoting point to a top front of said base frame;

said toilet seat support being a U-shaped member defining a forward opening, and being pivotally connected at pivoting points on a rear edge thereof to a top rear end of said movable frame;

said toilet seat being pivotally connected at a rear end to the rear edge of said toilet seat support to normally flatly position on a top of said toilet seat support;

said two sets of linkage being laterally symmetrically mounted to two inner sides of said base frame, each set of said linkage including a lower link and an upper link; said lower link being pivotally connected at a front end to an upper frame of said base frame and at a rear end to a rear end of said upper link; and said upper link being pivotally connected at a near-middle point to said movable frame, and in movable contact at a front end with an underside of said toilet seat; and said lifter including a base pivotally connected to a lower frame of said base frame, and an extension shaft having an outer end pivotally connected to a predetermined pivoting point on said movable frame.

2. The toilet seat lifting mechanism as claimed in claim 1, wherein said upper link of each said linkage is provided at the front end with a roller to rotatably contact with the underside of said toilet seat support.

3. The toilet seat lifting mechanism as claimed in claim 1, wherein said base frame is provided at two lateral sides with two armrests.

* * * * *